US007090472B2

(12) United States Patent
Achten

(10) Patent No.: US 7,090,472 B2
(45) Date of Patent: Aug. 15, 2006

(54) PUMP OR MOTOR WITH INTERCONNECTED CHAMBERS IN THE ROTOR

(75) Inventor: Peter A. J. Achten, Eindhoven (NL)

(73) Assignee: Innas Free Piston B.V. (NL)

( * ) Notice: Subject to any disclaimer, the term of this patent is extended or adjusted under 35 U.S.C. 154(b) by 0 days.

(21) Appl. No.: 10/449,368

(22) Filed: May 29, 2003

(65) Prior Publication Data

US 2003/0221551 A1 Dec. 4, 2003

(51) Int. Cl.
*F01N 3/00* (2006.01)
*F02K 3/00* (2006.01)

(52) U.S. Cl. ..... 417/270; 417/285; 91/472; 91/476

(58) Field of Classification Search ..... 417/242, 417/285, 521, 540, 543, 269, 270; 91/472, 91/476

See application file for complete search history.

(56) References Cited

U.S. PATENT DOCUMENTS

| | | | | |
|---|---|---|---|---|
| 3,156,192 A | | 11/1964 | Austin et al. | 103/162 |
| 3,202,105 A | | 8/1965 | Badenoch et al. | 103/162 |
| 4,096,786 A | * | 6/1978 | Schauer | 91/499 |
| 5,878,649 A | * | 3/1999 | Raab | 92/12.2 |
| 5,918,529 A | | 7/1999 | Forster | 92/12.2 |
| 6,024,541 A | * | 2/2000 | Perstnev et al. | 417/269 |

FOREIGN PATENT DOCUMENTS

| | | |
|---|---|---|
| FR | 1260078 A | 8/1961 |
| FR | 2082604 A | 12/1971 |
| NL | 1009607 C | 1/2000 |

OTHER PUBLICATIONS

International Search Report for International Application No. PCT/NL01/00839 mailed Mar. 14, 2002.

* cited by examiner

*Primary Examiner*—Charles G. Freay
(74) *Attorney, Agent, or Firm*—St. Onge Steward Johnston & Reens LLC

(57) ABSTRACT

Pump or motor having a rotor with chambers with a through rotation variable volume which are connectable via switches to either a first line connection or a second line connection. During switching between the line connections, the volume of the chamber changes and to avoid pressure peaks or cavitation the chambers are interconnected with connecting lines. Each connecting line has closures to stop the flow through the connecting line after a limited volume of fluid has passed in one direction.

8 Claims, 4 Drawing Sheets

PUMP OR MOTOR WITH INTERCONNECTED CHAMBERS IN THE ROTOR

The invention relates to a hydraulic device for converting mechanical energy into hydraulic energy or hydraulic energy into mechanical energy. A device of this type is known, inter alia, as a hydraulic pump or motor, and may be designed with axial plungers which can move inside chambers which are formed in the rotor. The switching means are formed by rotor ports which are connected to the chambers and move along a face plate with two face-plate ports. Between the face-plate ports there are ribs which, during rotation of the rotor, close off the rotor ports. These ribs are arranged slightly before or after the top or bottom dead center, so that the volume of the chamber changes during the time in which the chamber is closed off, and the pressure in the chamber changes, the position and size of the ribs being selected in such a manner that the change in the pressure corresponds to the difference between the pressures in the rotor ports.

BACKGROUND OF THE INVENTION

The drawback of this arrangement is that the position at which the ribs should be fitted is dependent on the pressure differences between the two face-plate ports, and since these pressure differences are not fixed, measures have to be taken to ensure correct operation in the event of differing pressure differences. These measures generally comprise the fitting of leakage grooves or a brief short circuit between the rotor ports by narrowing the rib, so that a chamber is simultaneously in communication with both rotor ports. This reduces the delivery while still not offering a good solution for all situations.

SUMMARY OF THE INVENTION

To avoid these drawbacks, the device of the invention is designed such that between chambers there are connecting lines which are provided with closure means for closing the connection line after a limited volume of fluid has flowed through the connection line in one direction. This makes the pressure change in the chamber more gradual and avoids pressure impulses and/or cavitation.

According to a refinement, the device is designed in a way that when the volume of the chamber is at its minimum, the line connection with the highest pressure is in communication with the chamber. This allows the closure means to function on the basis of the pressures in the chambers, resulting in a simple design.

According to one embodiment, the device is designed with switching means such that the rotational position of the rotor whereby a chamber is closed to both line connections, lies an adjustment angle (δ) after the rotational position as seen in the direction of rotation in which the volume in a chamber is at its minimum or maximum value. This results, in a simple manner, in a pump with closure means.

According to a simplified embodiment, the device is designed in that the switching means are adjusted by the rotation of the rotatable shaft. This makes the pump suitable, in a simple manner, for both directions of rotation.

According to one embodiment, the device is designed with switching means designed such that the rotational position of the rotor whereby a chamber is closed to both line connections, lies an adjustment angle (δ) before the rotational position as seen in the direction of rotation in which the volume in a chamber is at its minimum or maximum value. This results, in a simple manner, in a motor with closure means.

According to a simplified embodiment, the device is designed with switching means that are adjusted by the pressure line connections. This makes the motor suitable, in a simple manner, for use in both directions of load.

According to one emodiment; the device is designed such that over one complete revolution of the rotor, the volume of a chamber changes once from its minimum to its maximum, characterized in that the adjustment angle (δ) is approximately 10 degrees. This results in a design which is suitable for most conditions.

BRIEF DESCRIPTION OF THE DRAWINGS

The invention is explained below with reference to an exemplary embodiment in conjunction with a drawing, in which.

DETAILED DESCRIPTION OF THR DRAWINGS

Figure 1:
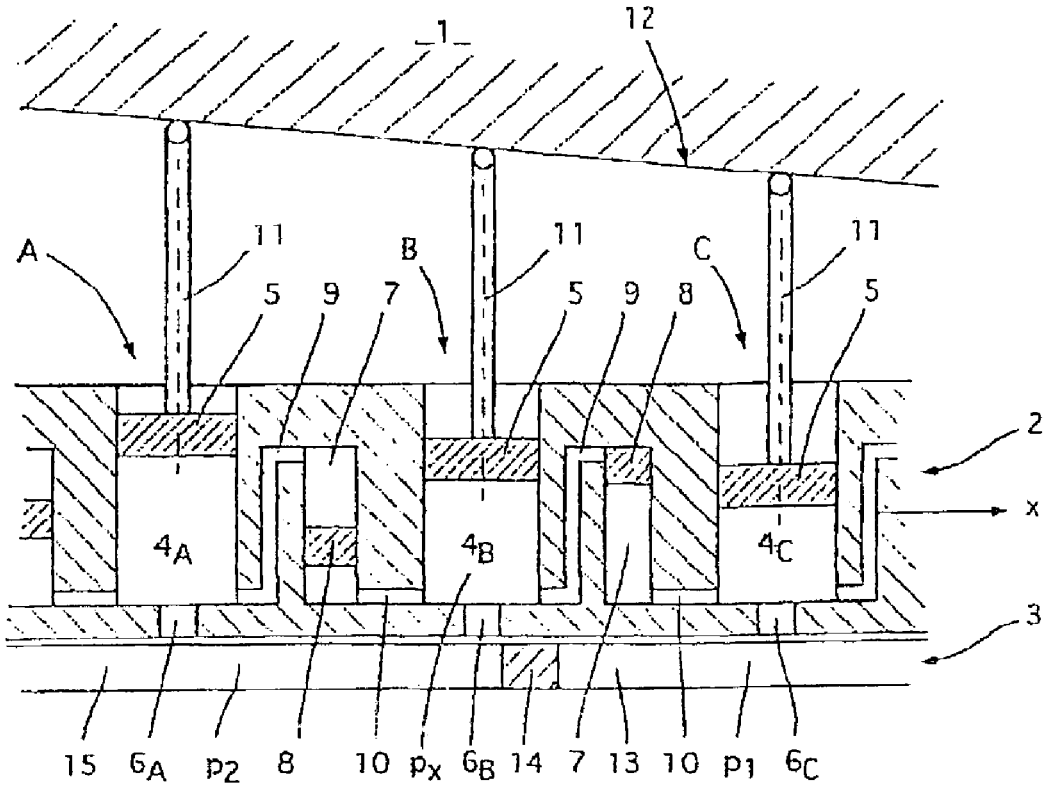
FIG. 1 diagrammatically depicts the operation of the invention.

FIG. 1 diagrammatically depicts a rotor 2 with rotor chambers $\mathbf{4}_A$, $\mathbf{4}_B$ and $\mathbf{4}_C$. The rotor 2 rotates in a housing 1. In the housing 1 there is a face plate 3 with a first face-plate port 13 and a second face-plate port 15. The face-plate ports 13 and 15 are separated by a rib 14. The first face-plate port 13 is connected to a line which is at a first pressure $P_1$. The second face-plate port 15 is connected to a line which is at a second pressure $P_2$. The rotor chambers 4 are each provided with a piston 5, so that the volume in the chamber 4 can vary between a minimum value and a maximum value by means of a displacement mechanism which in this case is diagrammatically indicated by a rod 11 and a guide 12. The rotor chamber 4 is in communication, through a rotor port 6 and face-plate port 13 or 15, with a line for supplying or discharging oil. The rotor 2 rotates about an axis of rotation, during which movement rotor ports 6 move along the face plate 3. Each rotor port 6 is initially in open communication with the second face-plate port 15. The pressure in the rotor chamber 4 is then equal to the second pressure $P_2$. After the rotor port 6 has passed the rib 14, the rotor port 6 is in open communication with the first face-plate port 13, and the pressure in the rotor chamber 4 is equal to the first pressure $P_1$. The rib 14 is dimensioned in such a way that the rotor port 6 is completely closed for a short time, so that it is impossible for there to be a short circuit between the first rotor port and the second rotor port 15.

Figure 2:
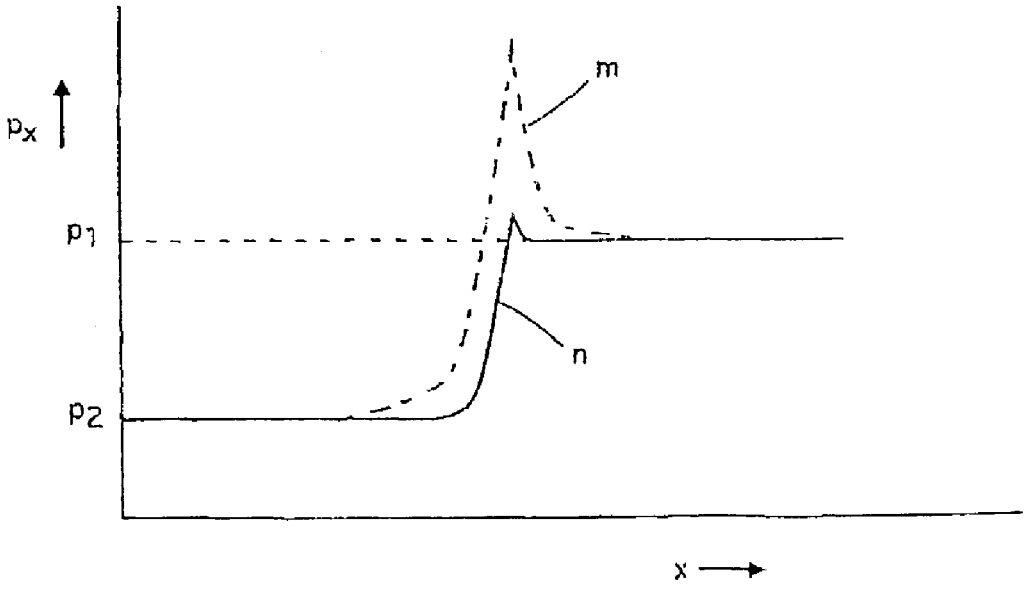
FIG. 2 diagrammatically depicts the pressure profile in a rotor chamber shown in FIG. 1.

In known rotors 2 oil is only supplied or removed via the rotor port 6. When this rotor port 6, during movement of the rotor 2, is completely or partially closed off by the rib 14 and the volume of the rotor chamber decreases under the influence of the guide 12 and the rod 11, the oil in the rotor chamber 4 will be elastically compressed, with the result that a rotor-chamber pressure $P_x$ rises. The rotor-chamber pressure $P_x$ is indicated in FIG. 2 as a function of the displacement of the rotor in a direction x. A line m indicates the rotor-chamber pressure $P_x$ as it rises in the known rotors 2 as a result of the opening 6 being closed by the rib 14. The illustrated rise in pressure is undesirable, since such a rapid rise in pressure causes excessive noise.

In order to prevent the pressure peaks in the rotor chamber 4 referred to above, according to the invention a valve chamber 7 in which there is a valve piston 8 is arranged between the rotor chambers. The space above the valve piston 8 is in communication, via a passage 9, with the first rotor chamber, in this case, for example, $\mathbf{4}_B$, and the space below the valve piston 8 is in communication with the second rotor chamber, in this case, for example, $\mathbf{4}_C$.

In the situation in which the first pressure $P_1$ is higher than the second pressure $P_2$, the pressure in the rotor chamber $\mathbf{4}_C$ is higher than in the rotor chamber $\mathbf{4}_B$. As a result of this pressure difference, the valve piston 8 between rotor chamber $\mathbf{4}_B$ and $\mathbf{4}_C$ will be positioned at the top of the valve chamber 7, as shown in FIG. 1. In this position, this valve piston 8 closes the passage 9, so that it is impossible for any oil to flow out of the rotor chamber $\mathbf{4}_C$ to the rotor chamber $\mathbf{4}_B$.

When the rotor 2 moves in the direction x, the rib 14 will close off the opening $\mathbf{6}_B$. On account of the downwardly directed movement of the piston 5, there is a flow of oil through the rotor port $\mathbf{6}_B$, which is impeded and in many cases ultimately stopped. As a result, the pressure $P_X$ rises, and the oil will first of all flow out through passage 10. The valve piston 8 between the rotor chamber $\mathbf{4}_A$ and $\mathbf{4}_B$ is subject to no resistance or only a limited resistance from the pressure in the rotor chamber $\mathbf{4}_A$ and will move into its uppermost position. After this valve piston 8 has reached its limit position, the flow of oil through passage 10 stops and the pressure in the rotor chamber $\mathbf{4}_B$ rises until it is equal to the first pressure $P_1$. Then, the flow of oil through passage 9 commences, and the valve piston 8 between the rotor chambers $\mathbf{4}_B$ and $\mathbf{4}_C$ will effect a flow of oil to the rotor chamber $\mathbf{4}_C$. The rotor-chamber pressure $P_x$ in the embodiment according to the invention is shown by a line n in FIG. 2. It is clearly apparent that the pressure changes from the second pressure $P_2$ to the first pressure $P_1$ with a much lower pressure peak, so that the excessive noise is greatly reduced. The peak which can be seen in FIG. 2 at line n results from the high rotational speed of the rotor, in this case 7200 rpm. Consequently, the acceleration of the valve piston 8 and the oil play a role. This pressure peak therefore forms on account of the mass of the oil column and the valve piston 8 to be accelerated.

The volume which has to be able to flow through the passages 9 and 10 during the closing and opening of the rotor port 6 is dependent on the displacement of the piston 5 during the time when the rotor port 6 is closed by the rib 14. The above-described principle using valve chambers 7 and valve pistons 8 enables the pressure in the rotor chamber 4 to change from the low pressure in a first face-plate port 15 to the high pressure in a second face-plate port 13 without pressure peaks or leaks if, during the closing of the rotor port 6 by the rib 14, between the two face-plate ports, the volume of the rotor chamber 4 decreases. Conversely, it is possible to allow the pressure in the rotor chamber 4 to drop from high pressure to low pressure without pressure peaks if, during the closing of the rotor port 14, the volume of the rotor chamber 4 increases. The application of this principle to hydraulic motors and pumps is explained below.

Figure 3A:
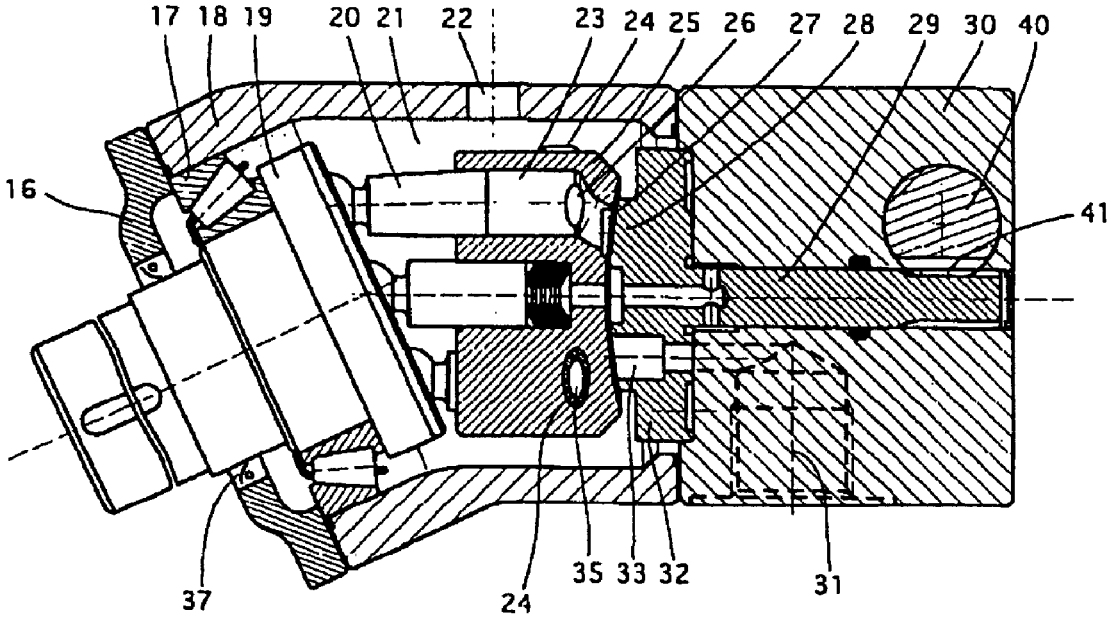
FIG. 3*a* shows a diagrammatic cross section through a hydraulic device according to the invention

The explanation given above has demonstrated that the valve chambers 7 are always arranged between two successive rotor chambers 4. Naturally, operation is similar if one or two rotor chambers 4 in each case lie between the rotor chambers 4 which are connected to a valve chamber 7. FIG. 3*a* shows a hydraulic device which can be used as a pump and as a motor A rotor 25 is secured rotatably in a housing 18. The rotor 25 has rotor chambers 23, the volume of which can vary between a minimum value and a maximum value through displacement of a plunger 20. The plungers 20 are coupled to a shaft 19 which is secured in the housing 18 by a bearing 17. In a cover 16 there is an oil seal 37, through which that end of the shaft 19 which is remote from the plungers 20 projects. This end of the shaft 19 can be coupled to equipment which is to be driven by the hydraulic device if the device is used as a motor or to equipment which drives the hydraulic device if it is used as a pump. The axis of rotation of shaft 19 intersects the axis of rotation of the rotor 25 at an angle, so that the plungers 20 move in a reciprocating manner in the rotor chambers 23. On the side which is remote from the plunger 20, the rotor chambers 23 are provided with a passage which ends in a rotor port 27.

The rotor ports 27 move along a circular path past a face plate 32 and, by means of two face-plate ports 33, are alternately connected to one of the two line connections 31. Ribs 28 are arranged between two face-plate ports 33 and, when the rotor 25 is rotating, briefly close off the rotor ports 27. The line connections 31 are arranged in a connection cover 30 which is provided with passages which are in communication with the corresponding face-plate port 33. An internal space 21 of the housing 18 is closed off by the cover 16, and the housing 18 is provided with a leakage connection 22. The face plate 32 is provided with a face-plate shaft 29 for rotatably positioning the face plate 32. The top half of FIG. 3 shows a first embodiment, in which the face plate 32 is rotated by means of oil pressure. To this end, a bore with a cylinder 40 is incorporated in the connection cover 30. The cylinder 40 is coupled to toothing 41 which meshes with the associated toothing of the face-plate shaft 29. The cylinder 40 can move under the influence of the oil pressure which prevails in the line connection 31, and as a result the face plate 32 rotates about the rotation shaft 29. If appropriate, there are means for setting the maximum size of the rotation angle of the face plate 32.

Figure 3B:
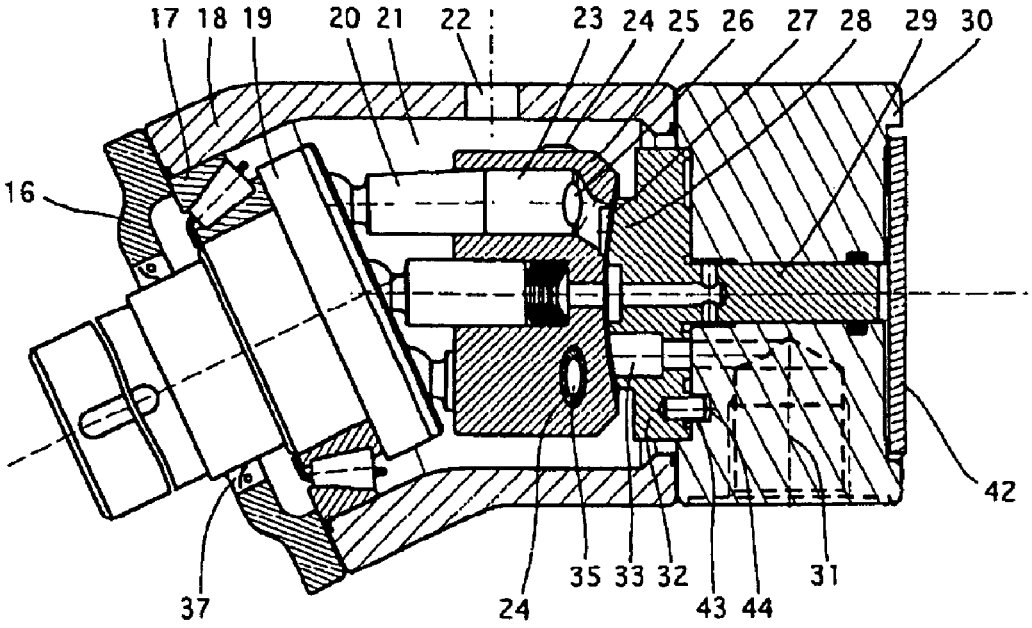
FIG. 3*b* shows a diagrammatic cross section through a hydraulic device according to the invention

FIG. 3*b* shows a second embodiment. In this case, the face-plate shaft 29 is of short design and the connection cover 30 is provided with a cover 42. The function of the face-plate shaft 29 is limited to that of guiding the face plate 32. Between the face plate 32 and the connection cover 30 there are chambers which are connected to the connection ports 31 and in which oil is under pressure. These chambers are dimensioned in such a manner that the friction caused by the oil pressure in the pump chambers 23 between face plate 32 and connection cover 30 is lower than the friction between the rotor 25 and the face plate 32. As a result, the face plate 32 will rotate in the same direction as the rotor 25. To limit the rotation of the face plate 32, the latter is provided with a pin 43 which can move in a slot 44 in the connection cover 30.

Figure 4:
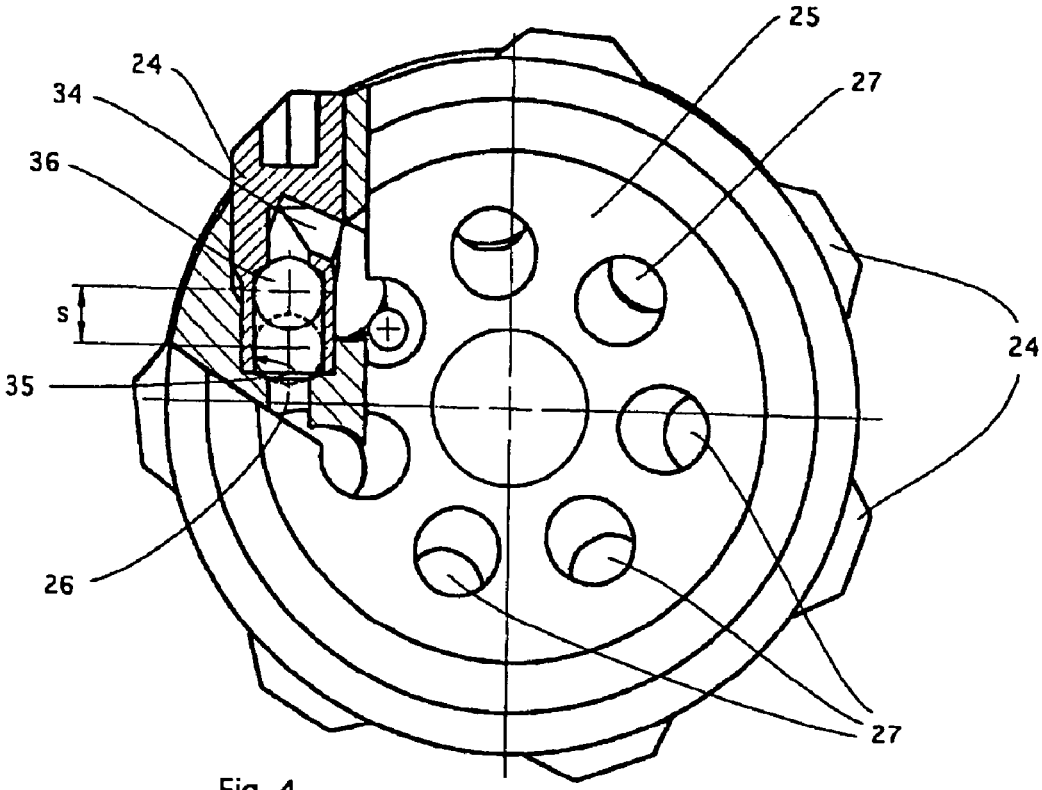
FIG. 4 shows a front view of the rotor of the hydraulic device shown in FIG. 3*a,*
Figure 5:
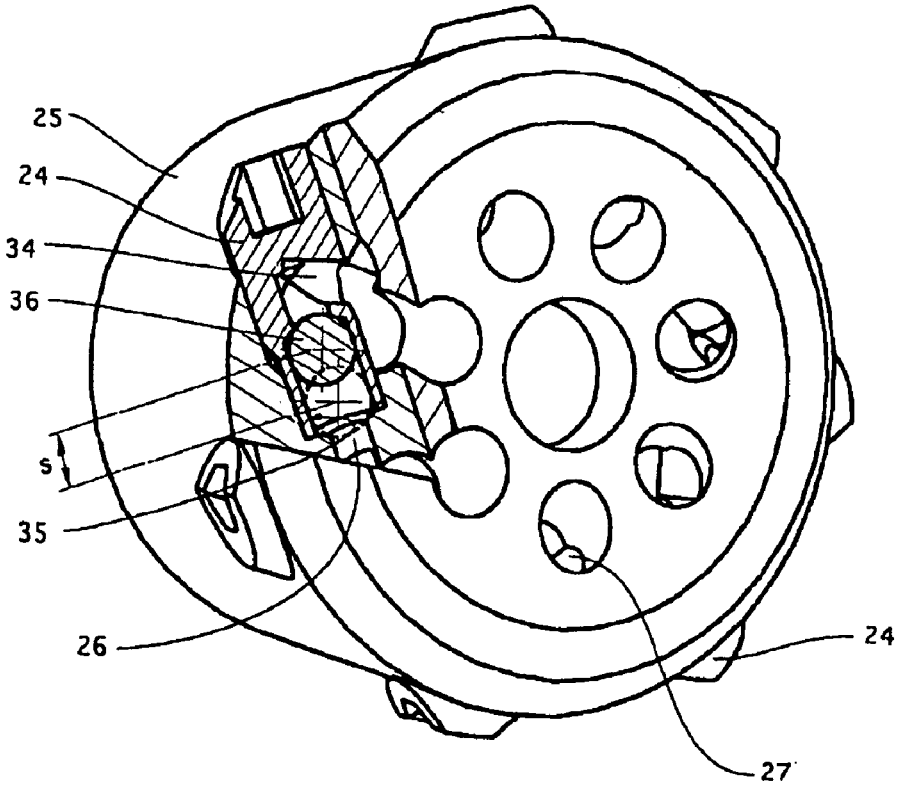
FIG. 5 shows a perspective view of the rotor shown in FIG. 3*a,*

FIGS. 4 and 5 show the rotor 25 in more detail. In the side of the rotor 25, a bore is in each case arranged between two rotor chambers 23, in the vicinity of the rotor port 27. A closure piece 24 is arranged in this bore. In this closure piece 24 there is a valve chamber 35 in which a ball 36 can move, and a bore 34 which brings the base of the valve chamber 35 into communication with one of the rotor chambers 23. The open end of the valve chamber 35 is connected, by means of a passage 26, to the other rotor chamber 23. In the mounted state of the closure piece 24 with the ball 36 in the rotor 25, the ball 36 blocks the flow of oil between the two rotor chambers 23 when the ball 36 has moved with the flow over a travel length s and, at one of the two ends of the valve chamber 35, has come to rest against a conical valve seat. In the process, a limited volume of oil has flowed from one rotor chamber 23 to the other rotor chamber 23; this volume is approximately equal to the product of the surface area of the ball 36 and the travel length s. The travel length s is therefore the maximum distance over which the ball 36 can move between the valve seats. The diameter of the ball 36 is greater than half the travel length s, so that the ball 36 is carried along by the liquid with little resistance. If appropriate, the diameter of the ball 36 may be greater than the travel length s. The material of the ball 36 is as lightweight as possible, and the ball is made, for example, from ceramic material. There is a certain clearance between the ball 36 and the valve chamber 35, so that a limited flow of oil past the ball 36 can take place. This enables the pressure change in the rotor chambers 23 to take place more gradually, allows the rotor to be vented and prevents local heating of the oil. If appropriate, to this end a groove is arranged in the longitudinal direction in the wall of the valve chamber 35. To limit the build-up of pressure in the rotor chamber 23 when the rotor port 27 is being closed off by the rib 28, the passage 26 and the bore 34 have a surface area which is at least 30% of the surface area of the rotor port 27; as a result, there will be little resistance to flow.

As an alternative to the embodiment illustrated with a ball 36 which comes to rest on a conical valve seat, other embodiments are also possible, for example a piston which can move in a sealed manner in the valve chamber 35, with the passages being connected to the side of the valve chamber 35. In the limit position, this piston comes to a stop against a closed volume of oil, so that an impact between the piston and the rotor is avoided, thus reducing wear.

Figure 6:
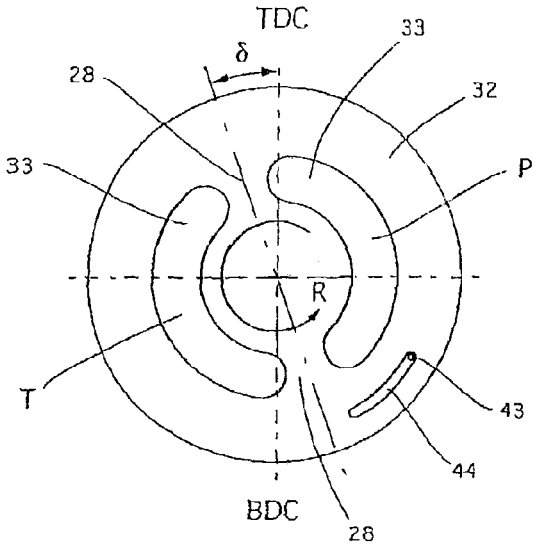
FIGS. 6 and 7 show a plan view of the face plate of the hydraulic device shown in FIG. 3*a*, designed as a pump operating in both directions of rotation.
Figure 7:
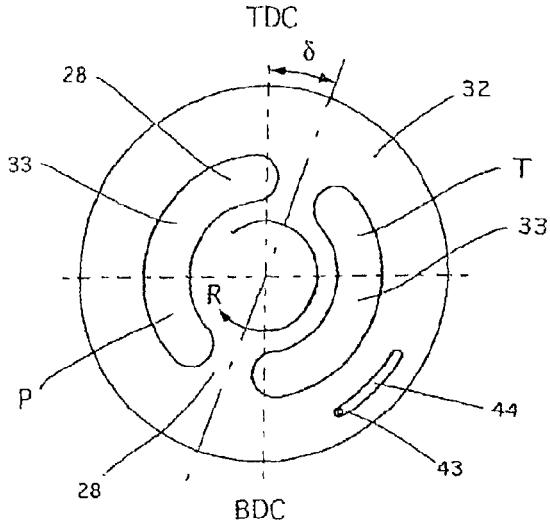

FIGS. 6 and 7 show a plan view of the face plate 32 of the device shown in FIG. 3, as seen from the direction of rotor 25. This view corresponds to the embodiment of the device as shown in the bottom half of FIG. 3. The device is used as a pump and the shaft 19 is driven. FIG. 6 shows the situation in which the rotor is driven in an anticlockwise direction of rotation R. As a result of the friction between the rotor 25 and the face plate 32, the face plate 32 is also rotated anticlockwise until it reaches the limit position of the pin 43 in the groove 44. In the figures, TDC (top dead center) indicates the position in which the volume of the chambers 23 is at its minimum. The rotor ports 33 are connected to a high-pressure connection P and a low-pressure connection T. The ribs 28 are indicated between the rotor ports 33. When the ribs 28 are passed over, the pressure in the rotor chamber 23 increases if the volume in the chamber falls, i.e., in FIG. 6, at the transition from the rotor port 33 connected to the low-pressure connection T to the rotor port 33 connected to the high pressure P. An adjustment angle δ of the face plate 32, which is determined by the length of the groove 44, is selected in such a manner that the compression of the liquid in the rotor chamber 23 leads to a rise in the pressure which is at least equal to the maximum difference between the pressure in the high-pressure connection P and the low-pressure connection T. Consequently, there is no additional change in the pressure when the rotor chamber 23, as it passes over the rib 28, comes into communication with the high pressure P, so that pressure peaks are avoided.

If the difference in the pressure between P and T is less than the maximum difference, the pressure in the rotor chamber 23 cannot become greater than the pressure P, since the ball 36 then moves in the valve chamber 35 and oil in the rotor chamber 23 is not compressed further, but rather is displaced to the rotor chamber 23, which is already in open communication with the high-pressure connection P. The situation in which, during passage over the rib 28, the volume in the rotor chamber 23 becomes greater is similar. In this case, a partial vacuum is avoided and there will be no cavitation. If appropriate, the rib 28 has a different length, since for the same increase in pressure in the chamber 23, given a large or small volume of the chamber 23, more or less compression has to take place.

FIG. 7 shows the corresponding situation to that shown in FIG. 6, except that in this case the direction of rotation of the rotor 25 is in the clockwise direction. Consequently, the face plate 32 has also been rotated to the limit position in which the center of the rib 28 forms the adjustment angle δ with a line passing through the TDC. The adjustment angle δ is approximately 10°–15°.

Figure 8:
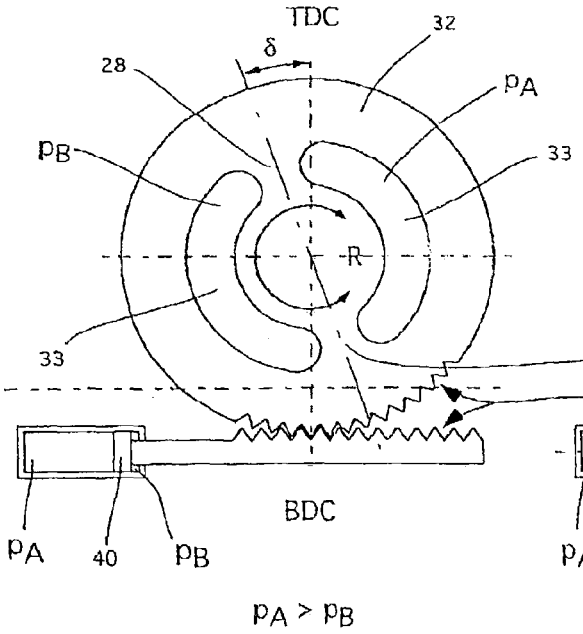
FIGS. 8 and 9 show a plan view of the face plate of the hydraulic device shown in FIG. 3*a* designed as a motor operating in both load directions.
Figure 9:
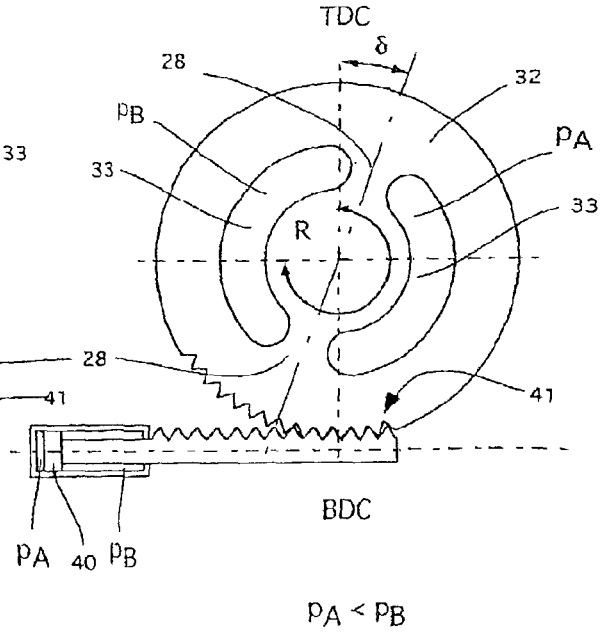

FIGS. 8 and 9 show plan views of the face plate 32 of the device shown in FIG. 3, as seen from the direction of the rotor 25. This view corresponds to the embodiment of the device as shown in the top half of FIG. 3. In this embodiment, the device shown in FIG. 3 is used as a motor, the pressures $P_A$ and $P_B$ in the line connections 31 determining the direction of the torque exerted by the motor. In figure 8, the pressure $P_A$ is higher than $P_B$, while in FIG. 9 the pressure $P_B$ is higher than $P_A$. The direction of rotation R of the rotor 25 is determined by the driven machine, and the motor shown can act in four quadrants, i.e. all four combinations of direction of rotation and direction of the torque are possible.

To allow this to take place, the rotary position of the face plate is adjusted by the cylinder 40 and the toothing 41, the cylinder being controlled by the pressures $P_A$ and $P_B$. The rotary position of the face plate 32 is in each case adjusted in such a way that the face-plate port 33 which is at the highest pressure is always in communication with a rotor chamber 23 when the volume of the latter is at its minimum. The adjustment angle δ is determined by the maximum of the pressure difference between $P_A$ and $P_B$ and is preferably approximately 10°–15°.

In the exemplary embodiment of the rotor 25 which is illustrated, the successive rotor chambers 23 are in each case connected to one another. Naturally, it is also possible for the rotor chambers 23 which lie one or two rotor chambers 23 apart, as seen in the direction of rotation, to be connected to one another. The exemplary embodiment shows a rotor 25 with axial plungers 20. The person skilled in the art is familiar with numerous other designs, such as wing pumps, radial plunger pumps, rotor pumps and roller pumps and corresponding motors; the volume of the chambers changing as a result of rotation. Numerous arrangements for alternately connecting chambers which change in volume as a result of rotation of a rotor to different line connections are also known. The invention can be applied equally well to these various applications for the purpose of avoiding pressure peaks and cavitation.

What is claimed is:

1. A hydraulic device for converting mechanical energy into a high pressure fluid flow or a high pressure fluid flow into mechanical energy, comprising a housing, a first line connection, a second line connection, a rotatable shaft for supplying or removing mechanical energy, a rotor which is coupled to the shaft, a plurality of chambers with a volume which, on account of the rotation of the rotor, varies between a minimum value and a maximum value, switching means for successively connecting a chamber to either the first line connection or the second line connection when the rotor is rotating, whereby the switching means are designed such that the volume of the chamber varies while the connection of the chambers changes from the first line connection to the second line connection, characterized in that the chambers are interconnected with passages within the rotor, said passages having closure means for closing the passages after a limited volume of fluid has flowed through the connecting lines in one direction.

2. The hydraulic device as claimed in claim 1, characterized in that the switching means are designed such that when the volume of a chamber is at its minimum, a line connection connected to the high pressure fluid flow is in communication with this chamber.

3. The hydraulic device as claimed in claim 1 for converting mechanical energy into a high pressure fluid flow, with the rotatable shaft being driven in a direction of rotation, characterized in that the switching means are designed such that the rotational position of the rotor whereby a chamber is closed to both line connections, lies an adjustment angle (δ) after the rotational position as seen in the direction of rotation in which the volume in a chamber is at its minimum or maximum value.

4. The hydraulic device as claimed in claim 3, characterized in that the switching means are designed such that when changing the direction of rotation said switching means are adjusted by the rotation of the rotatable shaft.

5. The hydraulic device as claimed in claim 1 for converting a high pressure fluid flow into mechanical energy for the purpose of driving equipment which is coupled to the rotatable shaft which rotates in a direction of rotation, characterized in that the switching means are designed such that the rotational position of the rotor whereby a chamber is closed to both line connections, lies an adjustment angle (δ) before the rotational position as seen in the direction of rotation in which the volume in a chamber is at its minimum or maximum value.

6. The hydraulic device as claimed in claim 5, characterized in that the switching means are adjusted by the pressure difference between the first and second connecting lines.

7. The hydraulic device as claimed in claim 3 in which, over one complete revolution of the rotor, the volume of a chamber changes once from its minimum to its maximum, characterized in that the adjustment angle (δ) is approximately 10 degrees.

8. The hydraulic device as claimed in claim 5 in which, over one complete revolution of the rotor, the volume of a chamber changes once from its minimum to its maximum, characterized in that the adjustment angle (δ) is approximately 10 degrees.

* * * * *